US006464021B1

(12) United States Patent
Edwards

(10) Patent No.: US 6,464,021 B1
(45) Date of Patent: Oct. 15, 2002

(54) EQUI-PRESSURE GEOSTEERING

(75) Inventor: John E. Edwards, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/475,871

(22) Filed: Dec. 30, 1999

Related U.S. Application Data

(63) Continuation-in-part of application No. 09/019,466, filed on Feb. 5, 1998, now Pat. No. 6,028,534.

(60) Provisional application No. 60/048,254, filed on Jun. 2, 1997.

(51) Int. Cl.[7] ..... E21B 7/04; E21B 47/04; E21B 47/09; E21B 47/06

(52) U.S. Cl. ..... 175/61; 175/45; 166/250.07; 166/254.2

(58) Field of Search ..... 175/45, 40, 61, 175/62; 166/254.1, 254.2, 250.07; 73/152.46, 152.51, 152.52

(56) References Cited

U.S. PATENT DOCUMENTS

| | | | | |
|---|---|---|---|---|
| 3,528,000 A | | 9/1970 | Schwede | |
| 3,934,468 A | | 1/1976 | Brieger | |
| 4,167,111 A | | 9/1979 | Spuck, III | |
| 4,893,505 A | | 1/1990 | Marsden et al. | |
| 4,936,139 A | | 6/1990 | Zimmerman et al. | |
| 5,103,920 A | * | 4/1992 | Patton | 175/45 |
| 5,165,274 A | | 11/1992 | Thiercelin | |
| 5,207,104 A | | 5/1993 | Enderlin | |
| 5,311,951 A | * | 5/1994 | Kyte et al | 175/40 |
| 5,622,223 A | | 4/1997 | Vasquez | |
| 5,765,637 A | | 6/1998 | Dietle et al. | |
| 5,812,068 A | * | 9/1998 | Wisler et al. | 175/40 |
| 6,028,534 A | * | 2/2000 | Ciglenec et al. | 166/117.5 |
| 6,161,630 A | * | 12/2000 | Stump et al. | 175/24 |

FOREIGN PATENT DOCUMENTS

| | | |
|---|---|---|
| EP | 0 490 420 B1 | 4/1995 |
| EP | 0 791 723 A1 | 8/1997 |
| EP | 0882871 A2 | 12/1998 |
| EP | 0984135 A2 | 3/2000 |
| EP | 1045113 A1 | 10/2000 |
| GB | 2307706 A | 9/1995 |

OTHER PUBLICATIONS

The Patent Office, Search Report Under Section 17, Great Britain.

Barry, et al., Geosteering Horizontal Wells in a Thin Oil Column, Copyright 1998, SPE Asia Pacific Oil & Gas Conference and Exhibition held in Perth, Australia Oct. 12–14, 1998, pp. 221–233.

* cited by examiner

*Primary Examiner*—Hoang Dang
(74) *Attorney, Agent, or Firm*—J. L. Jennie Salazar

(57) ABSTRACT

A method for determining a desirable depth for drilling a horizontal well within an oil reservoir includes the steps of deploying a plurality of data sensors at discrete depths in a subsurface formation penetrated by a wellbore, gathering formation pressure data for the discrete depths using the data sensors, and determining the depth of a reservoir using the gathered formation pressure data. The depth within the reservoir may be determined by identifying from the gathered formation pressure data at least one depth whose corresponding formation pressure is suggestive of a reservoir. Once such a depth is identified, the wellbore itself or a lateral drainhole depending from the wellbore may be steered into the reservoir by maintaining the trajectory of the wellbore or drainhole at a substantially constant distance from a fluid contact within the reservoir.

19 Claims, 5 Drawing Sheets

EQUI-PRESSURE GEOSTEERING

CROSS-REFERENCE TO RELATED APPLICATIONS

This application is a continuation-in-part of U.S. application Ser. No. 09/019,466, filed on Feb. 5, 1998, now U.S. Pat. No. 6,028,534 which claimed priority to U.S. Provisional Application Serial No. 60/048,254 filed Jun. 2, 1997.

BACKGROUND OF THE INVENTION

1. Field of the Invention

This invention relates generally to drilling of lateral wells into an oil rim accumulation or reservoir, and more particularly to the identification of the optimum vertical position for drilling such wells.

2. Description of the Related Art

Thin oil rim accumulations positioned between gas above and water below are difficult reservoirs to produce due to the tendency of water and gas to break through. Production of such accumulations from horizontal wells improves the ultimate recovery because the resulting increase in well productivity reduces the drawdown, and thereby reduces the coning of unwanted gas and water.

Known reservoir simulations can be used to estimate the optimum vertical position of a horizontal drainhole above the water contact and below the gas contact. Drilling a lateral well at this optimum drainhole position is difficult because geometric positioning during directional drilling is achieved with imperfect surveying instruments.

SPE Paper No. 50072 entitled "Geosteering Horizontal Wells in a Thin Oil Column," describes a method of horizontal drainhole positioning above the oil-water contact layer using resistivity determination. The resistivity directly above the oil-water contact zone will increase as the water saturation decreases to the irreducible value. This will occur over a transition zone.

The shape and height of this transition zone is characterized by a capillary pressure curve, which is a function of porosity and lithology. An empirical algorithm may be developed from offset-near-vertical well logs that relates the resistivity response to height above the oil-water contact for a range of porosities and clay contents.

There are several problems with this approach. For example, the resistivity value at a fixed distance above the oil-water contact is not unique. A range of such resistivity values exists depending on the formation porosity and lithology. Thus, in order to apply this technique, multiple formation measurements are required.

Another problem results from the fact that resistivity measurements are typically focussed perpendicular to the tool axis. Focussed resistivity measurements recorded in a near-vertical well will be dominated by the bed parallel resistivity, while focussed resistivity measurements taken in a near-horizontal well will be a combination of bed parallel and bed perpendicular resistivity. Thus, if resistivity anisotropy is present, it must be accounted for to apply an algorithm derived from vertical wells.

To address these shortcomings, it is a principal object of the present invention to provide formation pressure-versus-depth data for a subsurface formation that is useful for predicting the presence and depth of an oil reservoir. The formation pressure and gradient is established from offset near vertical wells, and used to relate formation pressure to absolute depth. This pressure gradient has been used to determine the vertical position of a completed well whose wellbore pressure is at equilibrium with the formation pressure by relating the wellbore pressure measured with a wireline production logging tool to the vertical height.

SUMMARY OF THE INVENTION

The object described above, as well as various objects and advantages, are achieved by a method that includes the steps of deploying a plurality of data sensors at discrete depths in a subsurface formation penetrated by a wellbore, gathering formation pressure data for the discrete depths using the data sensors, and determining a desirable depth for drilling a horizontal well within a reservoir using the gathered formation pressure data.

The formation pressure is gathered using receivers for receiving the formation pressure data transmitted by the data sensors. The receivers may be disposed within a downhole tool, and may be part of a drill string or part of a wireline sonde.

The depth within the reservoir may be determined by identifying from the gathered formation pressure data at least one depth whose corresponding formation pressure is suggestive of a reservoir. Once such a depth is identified, the wellbore itself or a lateral drainhole depending from the wellbore may be steered into the reservoir by maintaining the trajectory of the wellbore or drainhole at a substantially constant distance from a fluid contact within the reservoir.

In a preferred embodiment, the vertical depth within the reservoir is determined by comparing the gathered formation pressure data with a pre-determined formation pressure gradient. The pre-determined formation pressure gradient is established from vertical or near vertical offset wells using wireline formation pressure measurements, or from a near vertical section of the wellbore using Logging-While-Drilling ("LWD") formation pressure measurements.

BRIEF DESCRIPTION OF THE DRAWINGS

So that the manner in which the present invention attains the above recited features, advantages, and objects can be understood in detail, a more particular description of the invention is provided by reference to the preferred embodiment(s) thereof which are illustrated in the accompanying drawings.

It is to be noted however, that the appended drawings illustrate only typical embodiment(s) of this invention and are therefore not to be considered limiting of its scope, for the invention may admit to other equally effective embodiments.

In the drawings:

FIG. 1 is a schematic representation, partially in section, of a drilling rig supporting a drill string within a wellbore made in the earth by the drill string, and a plurality of remote sensing units that have been deployed from the wellbore into various formations of interest;

FIG. 2 is a diagram of a drill collar positioned in a wellbore following deployment from the drill collar of a remote sensing unit into a formation of interest;

FIG. 3 illustrates a portion of the drill collar of FIG. 2, including a downhole communication unit and a hydraulically energized system for forcibly inserting a remote sensing unit from the borehole into a selected subsurface formation;

FIG. 4 is an electronic block diagram schematically representing the downhole communication unit of the drill collar of FIG. 3 for communicating with a remote sensing unit or units;

FIG. 5 is an electronic block diagram schematically representing a remote sensing unit for sensing one or more formation data parameters such as pressure, temperature and rock permeability, placing the data in memory, and, as instructed, transmitting the stored data to a downhole communication unit;

FIG. 6 is an electronic block diagram schematically illustrating the receiver coil circuit of FIG. 5 in greater detail;

FIG. 7 is a transmission timing diagram showing pulse duration modulation used in communications between a downhole communication unit and a remote sensing unit; and FIG. 8 is a schematic representation of a wellbore with a plot of pressure versus depth, in accordance with the present invention, superimposed thereon.

DETAILED DESCRIPTION OF THE INVENTION

Figure 1:
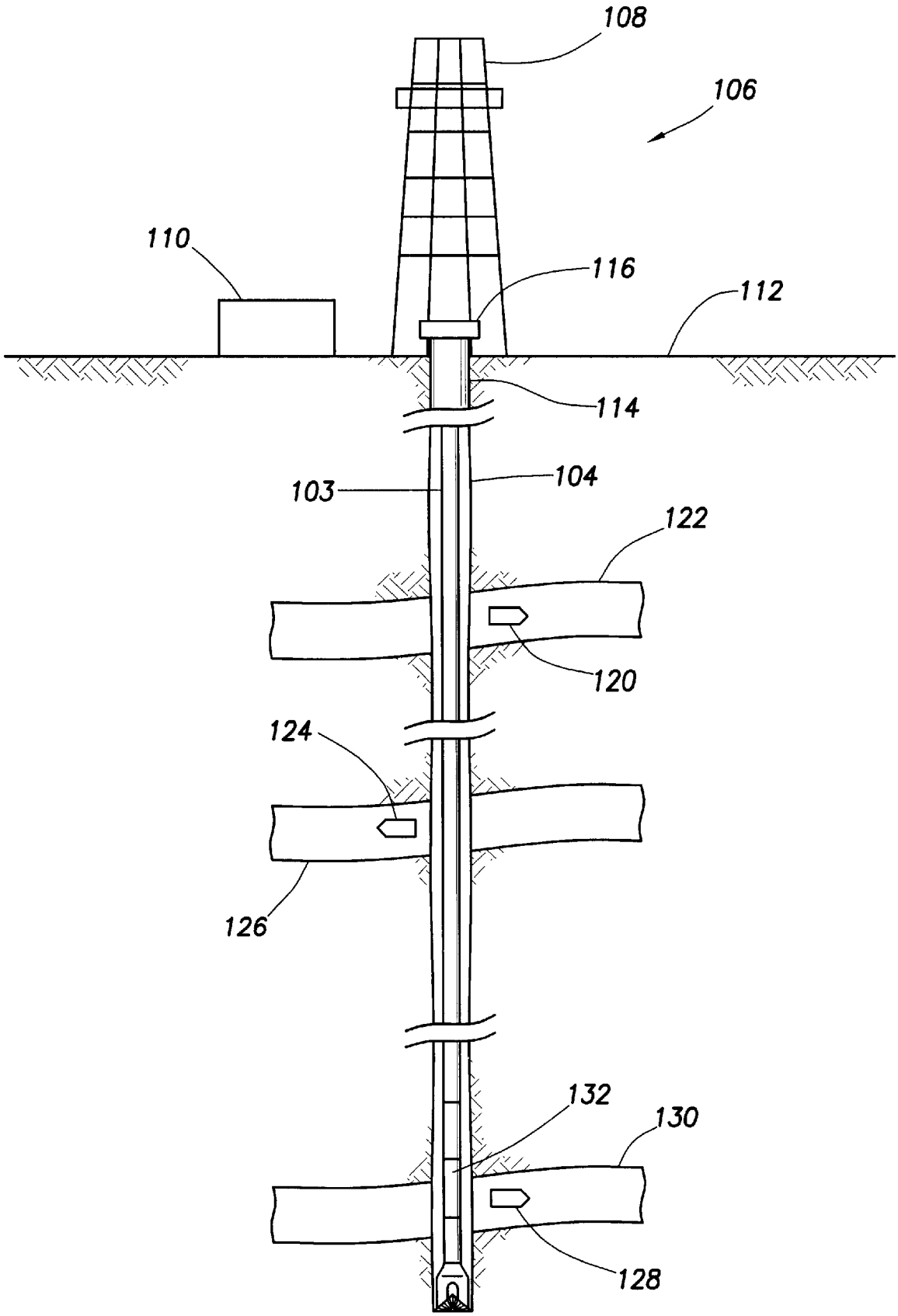

FIG. 1 illustrates drilling rig 106 supporting drill string 103 within wellbore 104 made in the earth by drill string 103 in one of the many known drilling techniques, including rotary drilling, directional drilling, or a combination of the two. A plurality of remote sensing units 120, 124 and 128 are shown positioned within various formations of interest, 122, 126 and 130, respectively, as a result of having been deployed from a tool positioned in wellbore 104.

Drilling for the discovery and production of oil and gas may be onshore (as illustrated) or may be off-shore or otherwise upon water. When offshore drilling is performed, a platform or floating structure is used to service the drilling rig. The present invention applies to both onshore and off-shore operations. For simplicity in description, onshore installations will be described.

When drilling operations commence, casing 114 is set and attached to earth 112 in cementing operations. Blow-out-preventer stack 116 is mounted onto casing 114 and serves as a safety device to prevent formation pressure from overcoming the pressure exerted upon the formation by a drilling mud column. Within wellbore 104 below casing 114 is an uncased portion of the wellbore that has been drilled in earth 112 in the drilling operations. This uncased portion of the wellbore or borehole is often referred to as the "open-hole."

According to the present invention, remote sensing units are deployed into formations of interest from wellbore 104. For example, remote sensing unit 120 is deployed into subsurface formation 122, remote sensing unit 124 is deployed into subsurface formation 126, and remote sensing unit 128 is deployed into subsurface formation 130. Remote sensing units 120, 124 and 128 measure properties of their respective subsurface formations. These properties include, for example, formation pressure, formation temperature, formation porosity, formation permeability and formation bulk resistivity, among other properties. This information enables reservoir engineers and geologists to characterize and quantify the characteristics and properties of subsurface formations 122, 126 and 130. Upon receipt, the formation data regarding the subsurface formation may be employed in computer models and other calculations to adjust production levels and to determine where additional wells should be drilled.

As contrasted to other measurements that may be made upon the formation using measurement while drilling (MWD) tools, mud logging, seismic measurements, well logging, formation samples, surface pressure and temperature measurements and other prior techniques, remote sensing units 120, 124 and 128 remain in the subsurface formations. Remote sensing units 120, 124 and 128 therefore may be used to continually collect formation information not only during drilling but also after completion of the well and during production. Because the information collected is current and accurately reflects formation conditions, it may be used to better develop and deplete the reservoir in which the remote sensing units are deployed. Furthermore, such information may be used for steering a horizontal component of the wellbore into a thin oil rim accumulation or reservoir in accordance with the present invention, as will be described below.

As indicated in FIG. 1, remote sensing units 120, 124 and 128 are preferably set during open-hole operations. The remote sensing units may be deployed from either a drill string tool that forms part of the collars of the drill string, or from an open-hole logging tool.

Figure 2:
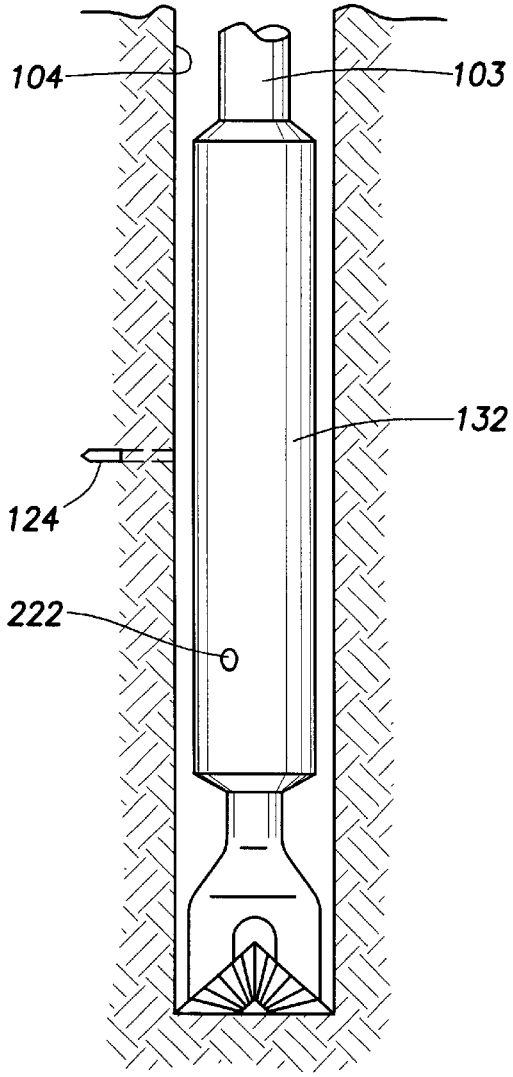
Figure 3:
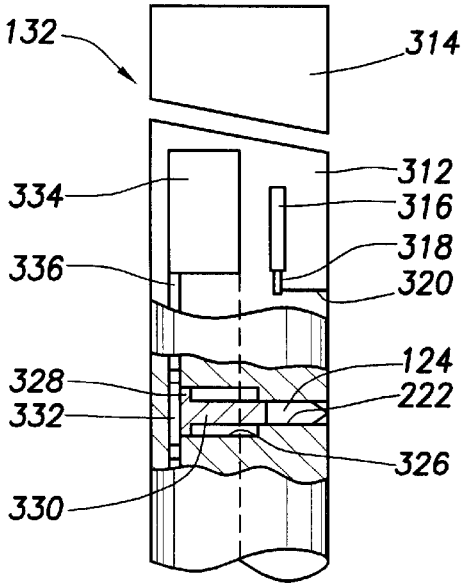

FIG. 2 illustrates deployment of remote sensing unit 124 from drill collar 132 of drill string 103 (also shown in FIG. 1). FIG. 3 shows that drill collar 132 is provided with an instrumentation section 312 and a power cartridge 314 incorporating the transmitter/receiver circuitry of FIG. 4. Instrumentation section 312 includes pressure gauge 316 having pressure transducer 318 exposed to wellbore pressure via drill collar passage 320. Pressure gauge 316 senses wellbore pressure at a depth of a selected subsurface formation and is used to verify pressure calibration of the remote sensing units. Electronic signals representing wellbore pressure are transmitted via pressure gauge 316 to the circuitry of power cartridge 314 which, in turn, accomplishes pressure calibration of the remote sensing unit being deployed at that particular well bore depth. Drill collar 132 is also provided with one or more remote sensing unit receptacles 222, each containing a remote sensing unit, such as remote sensing unit 124, for positioning within a selected subsurface formation which is penetrated by wellbore 104.

The remote sensing units are encapsulated "intelligent" remote sensing units which are moved from drill collar 132 to a position in the formation surrounding wellbore 104 for sensing formation parameters such as pressure, temperature, rock permeability, porosity, conductivity and dielectric constant, among others. The remote sensing units include sensors appropriately encapsulated in a remote sensing unit housing, or shell, of sufficient structural integrity to withstand damage during movement from the drill collar into laterally embedded relation with the subsurface formation surrounding the well bore. A shell consisting at least partially of a tungsten alloy is believed to be suitable for this purpose.

Those skilled in the art will appreciate that the lateral deployment or imbedding movement of the remote sensing unit(s) need not be perpendicular to wellbore 104, but may be accomplished through numerous angles of attack into the desired formation of interest. Deployment can be achieved by utilizing one or a combination of the following: (1) drilling into the wellbore wall and placing the remote sensing unit into the formation; (2) punching/pressing the remote sensing unit into the formation with a hydraulic press or mechanical penetration assembly; or (3) shooting the encapsulated remote sensing units into the formation by utilizing propellant charges.

As shown in the embodiment of FIG. 3, a hydraulically energized ram 330 is employed to deploy the remote sensing unit 124 and to cause its penetration into the subsurface formation to a sufficient position outwardly from the borehole that it senses selected parameters of the formation. For deployment of remote sensing unit 124, the drill collar is provided with an internal cylindrical bore 326 within which is positioned a piston element 328 having a ram 330 that is disposed in driving relation with the encapsulated remote intelligent remote sensing unit 124. The piston 328 is exposed to hydraulic pressure that is communicated to piston chamber 332 from a hydraulic system 334 via a hydraulic supply passage 336. The hydraulic system is selectively activated by the power cartridge 314 so that the remote sensing unit can be calibrated with respect to ambient borehole pressure at formation depth, as described above, and can then be moved from the receptacle 222 into the formation beyond the borehole wall so that the formation pressure parameters will be free from borehole effects.

Figure 4:
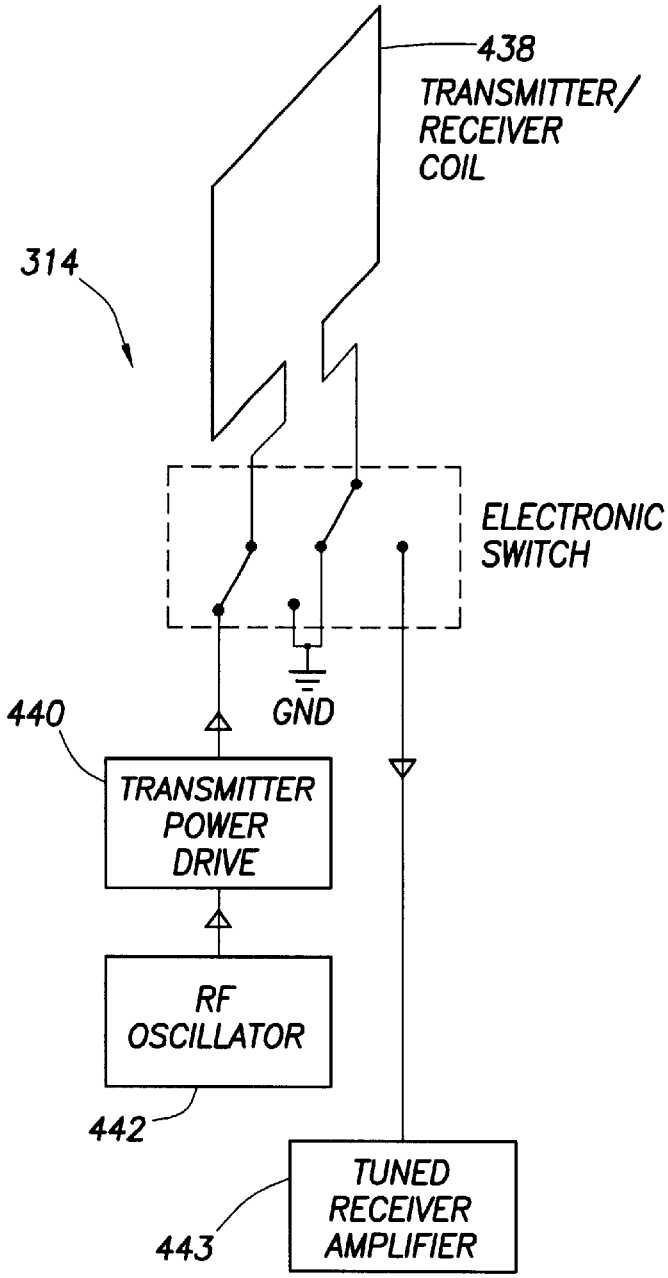

Referring now to FIG. 4, the power cartridge 314 of the drill collar 132 incorporates at least one transmitter/receiver coil 438 having a transmitter power drive 440 in a form of a power amplifier having its frequency F determined by oscillator 442. The drill collar instrumentation section is also provided with a tuned receiver amplifier 443 that is set to receive signals at a frequency 2F which will be transmitted to the instrumentation section of the drill collar by the remote sensing unit(s) as will be explained herein below.

Figure 5:
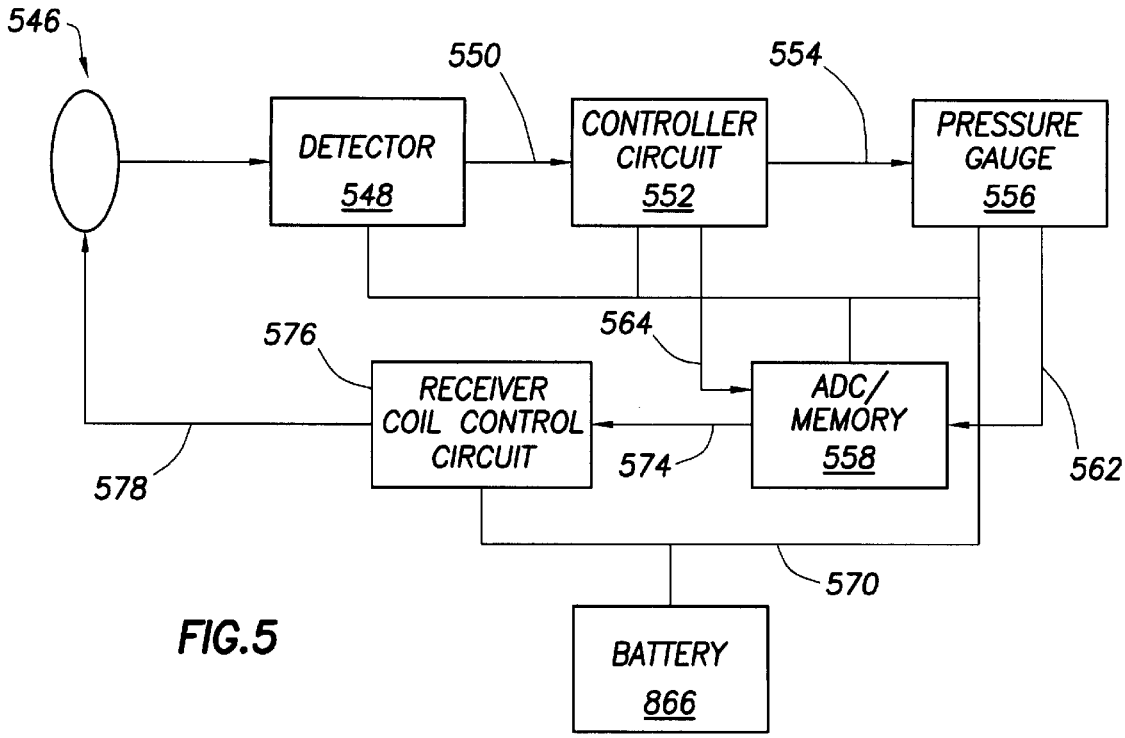

With reference to FIG. 5, the electronic circuitry of a remote sensing unit is shown by a block diagram and includes at least one transmitter/receiver coil 546, such as an RF antenna, with the receiver thereof providing an output 550 from a detector 548 to a controller circuit 552. The controller circuit is provided with one of its controlling outputs 554 being fed to a pressure gauge 556 so that gauge output signals will be conducted to an analog-to-digital converter ("ADC/Memory") 558, which receives signals from the pressure gauge via a conductor 562 and also receives controls signals from the controller circuit 552 via a conductor 564.

A battery 566 also is provided within the remote sensing unit circuitry and is coupled with the various circuitry components of the remote sensing unit by power conductor 570. While the described embodiment of FIG. 5 illustrates only a battery as a power supply, other embodiments of the invention include circuitry for receiving and converting RF power to DC power to charge a charge storage device such as a capacitor.

A memory output 574 of the ADC/Memory circuit 558 is fed to a receiver coil control circuit 576. The receiver coil control circuit 576 functions as a driver circuit via conductor 578 for the transmitter/receiver coil 546 to transmit data to instrumentation section 312 of drill collar 132.

Figure 6:
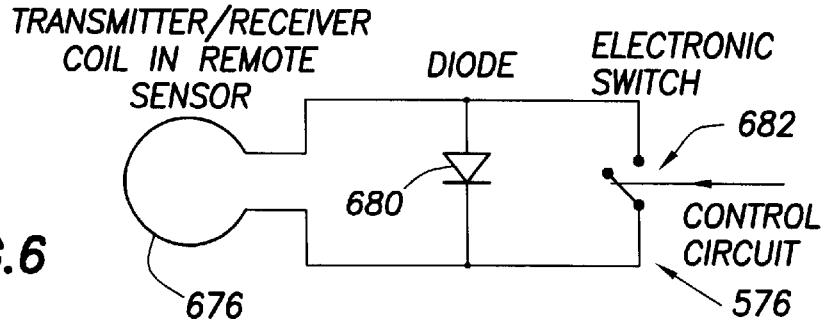

Referring now to FIG. 6, a low threshold diode 680 is connected across the receiver coil control circuit 676. Under normal conditions, and especially in the dormant or "sleep" mode, the electronic switch 682 is open, minimizing power consumption. When the receiver coil control circuit 576 is activated by the drill collar's transmitted electromagnetic field, a voltage and a current is induced in the receiver coil control circuit. At this point, however, the diode 680 will allow the current the flow only in one direction. This non-linearity changes the fundamental frequency F of the induced current shown at 784 in FIG. 7 into a current having the fundamental frequency 2F, in other words, twice the frequency of the electromagnetic wave 784 as shown at 786.

Throughout the complete transmission sequence, the transmitter/receiver coil 438, shown in FIG. 4, is also used as a receiver and is connected to a receiver amplifier 443 which is tuned at the 2F frequency. When the amplitude of the received signal is at a maximum, a remote sensing unit is located in close proximity for optimum transmission between drill collar and the remote sensing unit.

Figure 7:
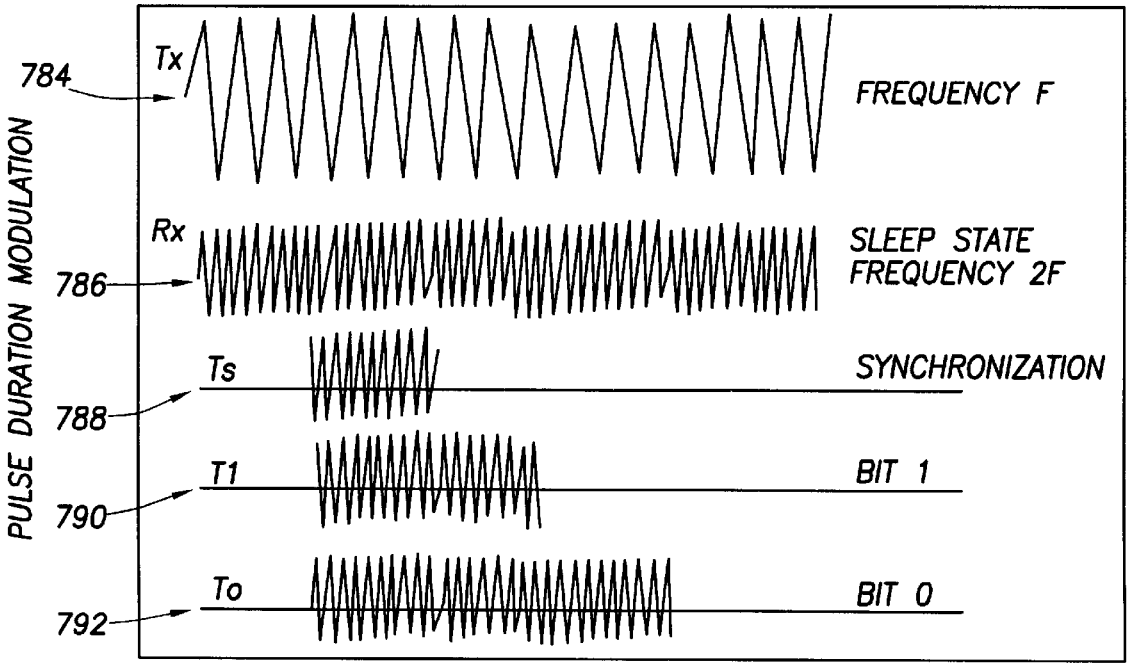

Assuming that remote sensing units are in place inside the formation to be monitored, the sequence in which the transmission and the acquisition electronics function in conjunction with drilling operations is as follows:

The drill collar with its acquisition sensors is positioned in close proximity of the remote sensing unit(s) 124. An electromagnetic wave having a frequency F, as shown at 784 in FIG. 7, is transmitted from the drill collar transmitter/receiver coil 438 to "switch on" the remote sensing unit and to induce the remote sensing unit to send back an identifying coded signal. The electromagnetic wave initiates the remote sensing unit's electronics to go into the acquisition and transmission mode, and pressure data and other data representing selected formation parameters, as well as the remote sensing unit's identification codes, are obtained at the remote sensing unit's level. The presence of the remote sensing unit is detected by the reflected wave scattered back from the unit at a frequency of 2F as shown at 786 in the transmission timing diagram of FIG. 7. At the same time, pressure gauge data (pressure and temperature) and other selected formation parameters are acquired and the electronics of the remote sensing unit converts the data into one or more serial digital signals. This digital signal or signals, as the case may be, is transmitted from the remote sensing unit back to the drill collar via the transmitter/receiver coil 746. This is achieved by synchronizing and coding each individual bit of data into a specific time sequence during which the scattered frequency will be switched between F and 2F. Data acquisition and transmission is terminated after stable pressure and temperature readings have been obtained and successfully transmitted to the on-board circuitry of the drill collar 132.

Whenever the sequence above is initiated, the transmitter/receiver coil 438 located within the instrumentation section of the drill collar is powered by the transmitter power drive or amplifier 440. And electromagnetic wave is transmitted from the drill collar at a frequency F determined by the oscillator 442, as indicated in the timing diagram of FIG. 7 at 784. The frequency F can be selected within the range 100 kHz up to 500 MHz. As soon as the target comes within the zone of influence of the collar transmitter, the transmitter/receiver coil 546 located within the remote sensing unit will radiate back an electromagnetic wave at twice the original frequency by means of the receiver coil control circuit 576 and the transmitter/receiver coil 546.

In contrast to present-day operations, the present invention makes pressure data and other formation parameters available while drilling, and, as such, allows well drilling personnel to make decisions concerning drilling mud weight and composition as well as other parameters at a much earlier time in the drilling process without necessitating the tripping of the drill string for the purpose of running a formation tester instrument. The present invention requires very little time to gather the formation data measurements. Once the remote sensing units are deployed, data can be obtained while drilling, a feature that is not possible according to known well drilling techniques.

Time dependent pressure monitoring of penetrated well bore formations can also be achieved. This feature is dependent of course on the communication link between the transmitter/receiver circuitry within the power cartridge of the drill collar and any deployed remote sensing units.

The remote sensing unit output can also be read with wireline logging tools during standard logging operations.

This feature of the invention permits varying data conditions of the subsurface formation to be acquired by the electronics of logging tools in addition to the real time formation data that is now obtainable while drilling.

By positioning the intelligent remote sensing units 124 beyond the immediate borehole environment, at least in the initial data acquisition period there will be very little borehole effects on the noticeable pressure measurements that are taken. As extremely small liquid movement is necessary to obtain formation pressures with in-situ sensors, it will be possible to measure formation pressure in fluid bearing non-permeable formations. Those skilled in the art will appreciate that the present invention is equally adaptable for measurements of several formation parameters, such as permeability, conductivity, dielectric constant, rocks strength, and others, and is not limited to formation pressured measurement.

As indicated previously, deployment of a desired number of such remote sensing units occurs at various wellbore depths as determined by the desired level of formation data. As long as the wellbore remains open, or uncased, the deployed remote sensing units may communicate directly with the drill collar, sonde, or wireline tool containing a data receiver to transmit data indicative of formation parameters to a memory module on the data receiver for temporary storage or directly to the surface via the data receiver.

The present invention utilizes the absolute formation pressure data available from a plurality of remote sensing units placed at discrete depths to steer and keep the trajectory of a well at a desirable depth. The pressure gradient across an oil rim in a subsurface formation creates a simple linear relationship between the pressure measurement and vertical depth if the oil-water contact is horizontal. The fluid contacts in unproduced reservoirs are only tilted if hydrodynamic forces exist. The presence of such forces can be identified by comparing several offset well formation pressure gradients.

The pressure-to-vertical depth relationship is easier to establish and is more direct than a resistivity-to-vertical depth relationship using a water saturation computation. Each absolute pressure measurement can be used to determine the depth, and therefore the height above the oil-water contact beneath a reservoir. This technique may be described as equi-pressure geosteering.

Figure 8:
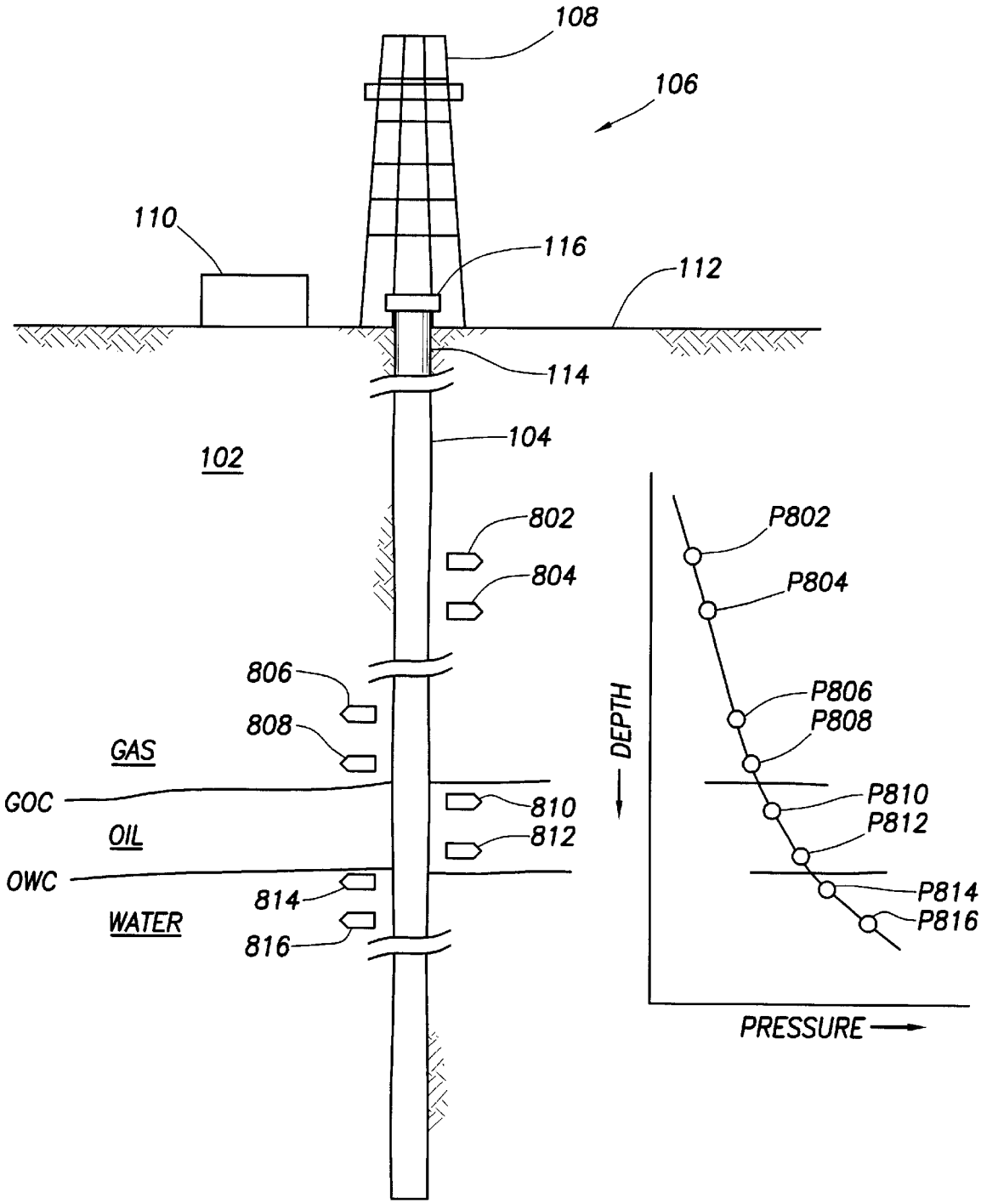

The equi-pressure geosteering method utilizes a plurality of deployed remote sensing units, such as sensing units 802–816 depicted in FIG. 8. Formation pressure data is gathered for the discrete depths at which the sensing units are respectively deployed, and a pressure-versus-depth profile is determined using the gathered formation pressure data.

The formation pressure is gathered using receivers for receiving the formation pressure data transmitted by the data sensors. The receivers may be disposed within a downhole tool, and may be part of a drill string as is described above in the form of drill collar 132 or may be part of a wireline sonde.

The vertical depth within an oil reservoir may be determined from a single formation pressure measurement, preferably in combination with an established formation pressure gradient. This formation pressure gradient is established from vertical or near vertical offset wells using wireline formation pressure measurements, or from the near vertical section of the current hole using Logging-While-Drilling ("LWD") formation pressure measurements. The LWD measurements may be of the type described above using a plurality of deployed remote sensing units, or may be of the type otherwise known in the art of acquiring Formation-Pressure-While-Drilling ("FPWD"). Once such a depth is identified, the primary wellbore or a lateral drainhole depending from the wellbore may be steered within the reservoir parallel and at a substantially constant offset depth from the fluid contacts by maintaining the trajectory of the wellbore or drainhole substantially at the identified depth.

Stated another way, the desired depth within an oil reservoir may be identified by plotting the pressure-versus-depth profile determined from sensing units 802–816, and observing changes in the slope of the data points. These slope changes are indicative of the gas-oil contact above the reservoir and the oil-water contact below the reservoir, and are illustrated in the plot shown in FIG. 8. Thus, the pressure data provides a guide for setting and maintaining the drilling at a desirable depth.

A formation pressure while drilling measurement which uses separate remote sensors is ideally suited for this application. The expected pressure at each deployment depth is generally known beforehand, so that each sensor can be equipped with a sensitive pressure transducer or gauge that covers a relatively narrow range such as, for example, a full scale deflection of only 50 psi. Assuming the absolute accuracy of each pressure measurement to be within +/−1 psi, the total depth will be determinable to within +/−1.3 feet in an 0.8 gm/cc oil column. The 2-sigma TVD error of a typical MWD survey instrument will reach this level after a 760 foot departure from a fixed reference such as a gas/oil contact. Any horizontal length drilled beyond this point could have an improved vertical positioning from formation pressure derived depth.

This approach only controls the vertical position of the drainhole. Azimuthal positioning of the well can be achieved either geometrically or through geosteering using LWD measurements to avoid non-reservoir formations.

In view of the foregoing it is evident that the present invention is well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A method for indicating a desirable vertical depth for drilling a horizontal well within a reservoir, comprising:

deploying a plurality of data sensors at discrete depths in a subsurface formation penetrated by a wellbore;

gathering formation pressure data for the discrete depths using the data sensors; and determining the vertical depth within a reservoir using the gathered formation pressure data.

2. The method of claim 1, wherein the formation pressure is gathered using receivers for receiving the formation pressure data transmitted by the data sensors.

3. The method of claim 2, wherein the receivers are disposed within a downhole tool.

4. The method of claim 3, wherein the downhole tool is part of a drill string.

5. The method of claim 3, wherein the downhole tool is part of a wireline sonde.

6. The method of claim 1, wherein the depth within the reservoir is determined by identifying from the gathered formation pressure data at least one depth whose corresponding formation pressure is suggestive of a reservoir.

7. The method of claim 6, further comprising steering a lateral drainhole from the wellbore at a substantially constant distance from a fluid contact within the reservoir.

8. The method of claim 7, wherein the lateral drainhole is steered by maintaining the trajectory of the drainhole substantially at the one identified depth.

9. The method of claim 6, further comprising steering the wellbore laterally into the reservoir.

10. The method of claim 9, wherein the wellbore is steered laterally by maintaining the trajectory of the drainhole substantially at the one identified depth.

11. The method of claim 1, wherein the depth of the reservoir is determined by identifying from the gathered formation pressure data a formation pressure-versus-depth profile.

12. The method of claim 11, further comprising identifying the gas-oil contact depth and the oil-water contact depth.

13. The method of claim 11, further comprising steering a lateral drainhole from the wellbore at a substantially constant distance from a fluid contact within the reservoir.

14. The method of claim 12, wherein the lateral drainhole is steered by maintaining the trajectory of the drainhole substantially at a depth between the gas-oil contact depth and the oil-water contact depth.

15. The method of claim 1 further comprising steering the wellbore laterally into the reservoir.

16. The method of claim 15, wherein the wellbore is steered laterally by maintaining the trajectory of the drainhole substantially at a depth between the gas-oil contact depth and the oil-water contact depth.

17. The method of claim 1, wherein the vertical depth within the reservoir is determined by comparing the gathered formation pressure data with a pre-determined formation pressure gradient.

18. The method of claim 17, wherein the pre-determined formation pressure gradient is established from vertical or near vertical offset wells using wireline formation pressure measurements.

19. The method of claim 17, wherein the pre-determined formation pressure gradient is established from a near vertical section of the wellbore using LWD formation pressure measurements.

* * * * *